US007165419B2

(12) United States Patent
Song et al.

(10) Patent No.: US 7,165,419 B2
(45) Date of Patent: Jan. 23, 2007

(54) APPARATUS FOR CONVERTING REFRIGERANT PIPE OF AIR CONDITIONER

(75) Inventors: Chan-Ho Song, Gyeonggi-Do (KR); Seung-Youp Hyun, Seoul (KR); Won-Hee Lee, Seoul (KR); Jeong-Taek Park, Seoul (KR); Yoon-Jei Hwang, Seoul (KR)

(73) Assignee: LG Electronics Inc., Seoul (KR)

( * ) Notice: Subject to any disclaimer, the term of this patent is extended or adjusted under 35 U.S.C. 154(b) by 196 days.

(21) Appl. No.: 11/023,521

(22) Filed: Dec. 29, 2004

(65) Prior Publication Data

US 2005/0235684 A1 Oct. 27, 2005

(30) Foreign Application Priority Data

Apr. 22, 2004 (KR) ..... 10-2004-0027943

(51) Int. Cl.
*F25B 1/10* (2006.01)

(52) U.S. Cl. ..... 62/510

(58) Field of Classification Search ..... 62/196.4, 62/226, 228.3, 510; 137/522, 597, 599.11, 137/892; 261/147, 151, 153, 158
See application file for complete search history.

(56) References Cited

U.S. PATENT DOCUMENTS 4,167,102 A * 9/1979 Willitts ..... 62/152
4,193,270 A * 3/1980 Scott ..... 62/175
4,418,548 A * 12/1983 Sawyer ..... 62/175
4,474,026 A * 10/1984 Mochizuki et al. ..... 62/157
4,537,047 A * 8/1985 Seshadri et al. ..... 62/510
4,554,795 A * 11/1985 Ibrahim ..... 62/175
4,621,505 A * 11/1986 Ares et al. ..... 62/509
4,750,337 A * 6/1988 Glamm ..... 62/468
5,265,434 A * 11/1993 Alsenz ..... 62/117
5,634,345 A * 6/1997 Alsenz ..... 62/84
5,685,168 A * 11/1997 Sada ..... 62/473
6,263,694 B1 * 7/2001 Boyko ..... 62/468
6,928,825 B1 * 8/2005 Alsenz ..... 62/116

FOREIGN PATENT DOCUMENTS

JP 2000-88368 A * 3/2000

* cited by examiner

*Primary Examiner*—Mohammad M. Ali
(74) *Attorney, Agent, or Firm*—Birch, Stewart, Kolasch and Birch, LLP

(57) ABSTRACT

An apparatus for converting a refrigerant pipe of an air conditioner comprises: a valve housing installed at a position where respective refrigerant discharge pipes of plural compressors are put together, having a valve space portion therein, and composed of a first refrigerant inlet, a second refrigerant inlet, a refrigerant outlet, a bypass outlet, and a detour refrigerant outlet at upper and lower sides thereof; a bypass pipe for connecting the refrigerant outlet of the valve housing to refrigerant suction pipes of the compressors so that a refrigerant discharged from each refrigerant discharge pipe of the compressors can be introduced into the refrigerant suction pipes of the compressors; an open/close valve slidably installed in the valve space portion of the valve housing so that a refrigerant discharged from the refrigerant discharge pipe can be selectively introduced into the refrigerant circulation pipe of the condenser or the bypass pipe; and an open/close valve driving means installed at the valve housing and driving the open/close valve.

16 Claims, 6 Drawing Sheets

APPARATUS FOR CONVERTING REFRIGERANT PIPE OF AIR CONDITIONER

BACKGROUND OF THE INVENTION

1. Field of the Invention

The present invention relates to an apparatus for converting a refrigerant pipe of an air conditioner, and more particularly, to an apparatus for converting a refrigerant pipe of an air conditioner capable of preventing a backflow of a refrigerant even when an air conditioner is stopped and capable of fast re-operating the air conditioner by removing a pressure difference between a refrigerant suction side and a refrigerant discharge side before re-operating the air conditioner.

2. Description of the Conventional Art

Generally, a refrigerating cycle of an air conditioner repeatedly performs a compression process, a condensation process, an expansion process, and an evaporation process. The refrigerating cycle is composed of: a compressor for compressing a refrigerant of a low temperature and a low pressure and thereby converting into a refrigerant of a high temperature and a high pressure; a condenser for condensing a refrigerant of a high temperature and a high pressure into a liquid state; an expander for expanding a condensed refrigerant and thereby converting into a refrigerant of a low temperature and a low pressure; and refrigerant pipes for connecting the compressor, the condenser, and the expander one another.

It is general that one compressor is adopted in an air conditioner. However, recently, plural compressors are adopted in an air conditioner in order to enhance an energy consumption efficiency and to vary a compression function of a compressor according to a load size of a refrigerating cycle.

FIG. 1 is a conceptual view showing a refrigerating cycle of an air conditioner in accordance with the conventional art.

As shown in FIG. 1, the conventional air conditioner comprises: a compressor 1 for compressing a refrigerant; a check valve 2 for preventing a backflow of a refrigerant discharged from the compressor 1; a condenser 30 for condensing a compressed refrigerant into a liquid state; and an evaporator 40 for evaporating a condensed refrigerant.

An electron expansion valve 5 for controlling a flow of a refrigerant according to an operated state of the compressor 11 is installed between the condenser 30 and the evaporator 40. Also, an accumulator 6 for preventing a liquid refrigerant that has not been vaporized from being introduced into the compressor 11 is installed between the evaporator 40 and the compressor 11.

In the refrigerating cycle of the conventional air conditioner, when a refrigerant is compressed as the compressor 11 is operated, the compressed refrigerant is introduced into the condenser 30 via the check valve 2 thus to be condensed. Then, the condensed refrigerant is introduced into the evaporator 40 via the electron expansion valve 5. The refrigerant introduced into the evaporator 40 is vaporized thus to form cool air, and the cool air is blown indoors through a cool air vent of an indoor unit (not shown).

FIG. 2 is a perspective view showing an outdoor unit of the conventional air conditioner having plural compressors, and FIG. 3 is a perspective view showing refrigerant pipes and check valves connected to the plural compressors of the conventional air conditioner.

As shown in FIG. 2, an outdoor unit 10 of the conventional air conditioner includes: plural compressors 11 and 12 for compressing a refrigerant into a high temperature and a high pressure; a condenser 30 for condensing a refrigerant of a high temperature and a high pressure; and an outdoor fan 14 for blowing external air to the condenser 30. An unexplained reference numeral 15 denotes a cover.

A structure of the plural compressors will be explained with reference to FIG. 3. A refrigerant suction pipe 11*a* and a refrigerant discharge pipe 11*b* are respectively formed at one side and another side of the first compressor 11. Also, a refrigerant suction pipe 12*a* and a refrigerant discharge pipe 12*b* are respectively formed at one side and another side of the second compressor 12.

The refrigerant suction pipes 11*a* and 12*a* are connected to each other in parallel, and the refrigerant discharge pipes 11*b* and 12*b* are connected to each other in parallel. A check valve 2 for preventing a backflow of a refrigerant is installed at each refrigerant discharge pipe 11*b* and 12*b*.

Unexplained reference numeral 6 denotes an accumulator, 31 denotes a refrigerant circulation pipe of a condenser, and 32 denotes a refrigerant circulation pipe of a suction side of the compressor.

In the conventional air conditioner, the first compressor 11 and the second compressor 12 are respectively operated thereby to suck a refrigerant through the refrigerant suction pipes 11*a* and 12*a* and compress. The compressed refrigerant is introduced into the condenser 30 through the refrigerant discharge pipes 11*b* and 12*b* via the check valve 2. Then, the refrigerant is condensed by the condenser 30 of FIG. 2, and then passes through the evaporator 40 of FIG. 1 thus to be vaporized and to form cool air. The cool air is blown indoors through a cool air vent of an indoor unit (not shown). The refrigerant vaporized while passing through the evaporator 40 is introduced into the first compressor 11 and the second compressor 12 via the refrigerant circulation pipe 32 and the refrigerant suction pipes 11*a* and 12*a*. The above processes are repeated.

While the air conditioner is operated, a user can temporarily stop the operation of the air conditioner in order to perform a defrosting operation to remove frost unnecessarily formed during a cooling operation and then re-operate the air conditioner. In this case, a pressure difference between a refrigerant suction side and a refrigerant discharge side is generated and thereby the air conditioner can not be re-operated within a certain time.

That is, at the time of re-operating the air conditioner after a temporal stopping, the user has to re-operate the air conditioner after removing a pressure difference between a refrigerant suction side (a lower side of the check valve) and a refrigerant discharge side (an upper side of the check valve). According to this, it takes a lot of time to re-operate the air conditioner.

The above phenomenon is generated more severely by the check valve 2 installed at the refrigerant discharge pipes 11*b* and 12*b*. Even if the check valve 2 prevents a backflow of a refrigerant while the air conditioner is operated, the check valve causes a pressure difference between the refrigerant suction side and the refrigerant discharge side at the time of re-operating the air conditioner thereby to take a lot of time to re-operate the air conditioner.

SUMMARY OF THE INVENTION

Therefore, an object of the present invention is to provide an apparatus for converting a refrigerant pipe of an air conditioner capable of preventing a backflow of a refrigerant even after a stopping of an air conditioner and capable of fast re-operating an air conditioner by removing a pressure difference between a refrigerant suction side and a refrigerant discharge side before re-operating the air conditioner.

To achieve these and other advantages and in accordance with the purpose of the present invention, as embodied and broadly described herein, there is provided an apparatus for converting a refrigerant pipe of an air conditioner comprising: a valve housing installed at a position where respective refrigerant discharge pipes of plural compressors are put together, and having a valve space portion therein; a bypass pipe for connecting a refrigerant outlet of the valve housing to refrigerant suction pipes so that a refrigerant discharged from each refrigerant discharge pipe can be introduced into the refrigerant suction pipes of the plural compressors; an open/close valve slidably installed at the valve space portion of the valve housing so that a refrigerant discharged from the refrigerant discharge pipes can be selectively introduced into a refrigerant circulation pipe of a condenser or the bypass pipe; and an open/close valve driving means installed at the valve housing and driving the open/close valve.

The valve housing is composed of: a first refrigerant inlet formed at one lower portion thereof, for connecting the valve space portion and a refrigerant discharge pipe of a first compressor; a second refrigerant inlet formed at another lower portion thereof, for connecting the valve space portion and a refrigerant discharge pipe of a second compressor; a refrigerant outlet formed at one upper portion thereof and connected to the refrigerant circulation pipe of the condenser; a bypass outlet formed at another upper portion thereof and connected to the refrigerant circulation pipe of the condenser; and a detour refrigerant outlet formed at a side of the bypass outlet, for connecting the valve space portion and the bypass outlet.

The open/close valve driving means is composed of: a pair of springs installed at both sides of the open/close valve; and a pair of electromagnets installed at both sides of the valve housing, for overcoming an elastic force of the springs and pulling the open/close valve.

The open/close valve is composed of: a first open/close portion for opening and closing the refrigerant outlet; a second open/close portion for opening and closing the bypass outlet; and a connection portion for connecting the first open/close portion and the second open/close portion.

The first open/close portion and the second open/close portion correspond to each other, and are adhered to an inner wall of the valve space portion with the same diameter. The connection portion is formed to have a diameter shorter than diameters of the first open/close portion and the second open/close portion.

One end of a first refrigerant discharge pipe of a first compressor and one end of a second refrigerant discharge pipe of a second compressor are respectively fitted into the first refrigerant inlet and the second refrigerant inlet of the valve housing with a sealed state. Also, one end of the refrigerant circulation pipe and one end of the bypass pipe are respectively fitted into the refrigerant outlet and the bypass outlet with a sealed state.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Hereinafter, an apparatus for converting a refrigerant pipe of an air conditioner according to the present invention will be explained with reference to the attached drawings as follows.

Figure 4:
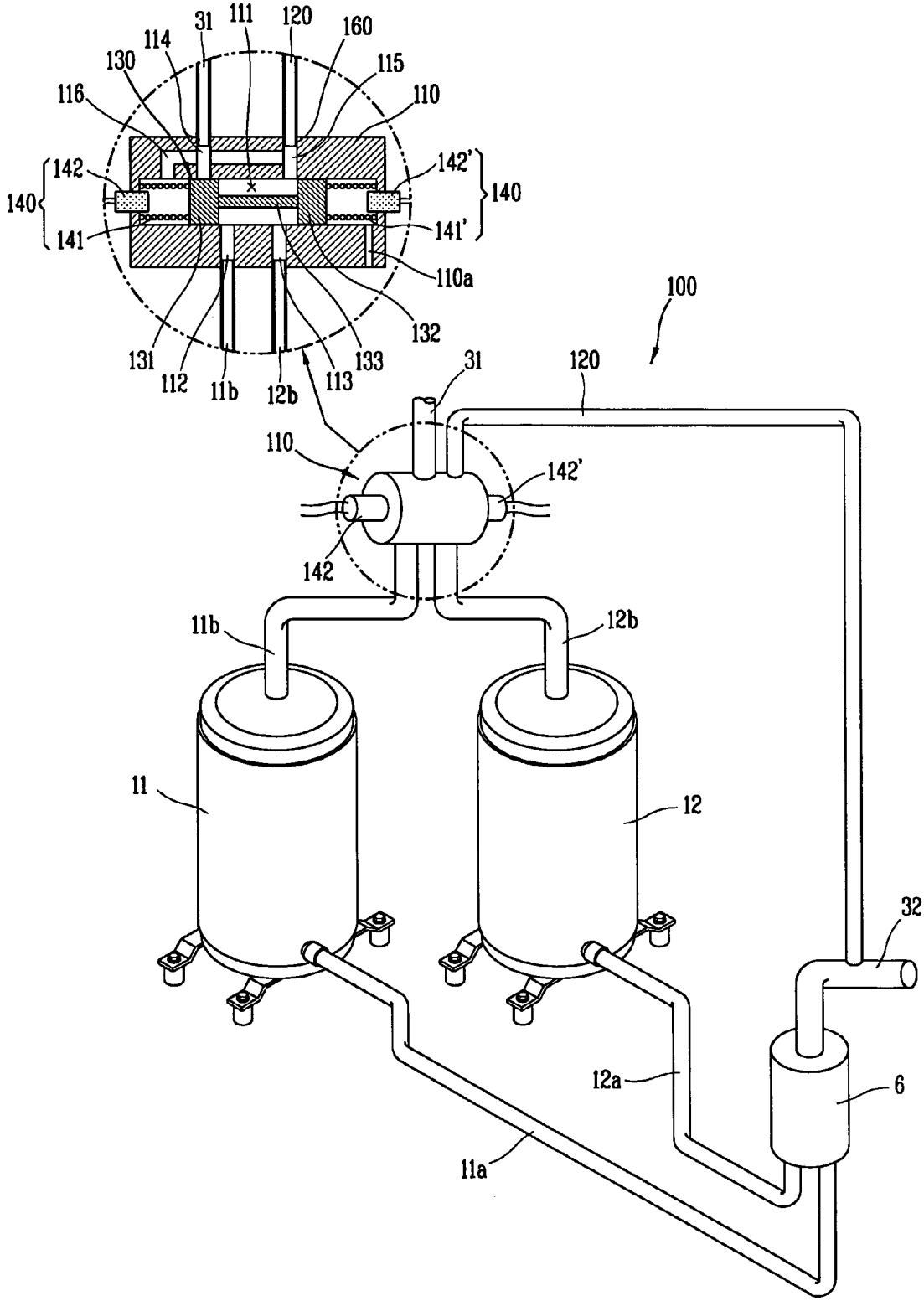
FIG. 4 is a perspective view showing an apparatus for converting a refrigerant pipe of an air conditioner according to the present invention.
Figure 5:
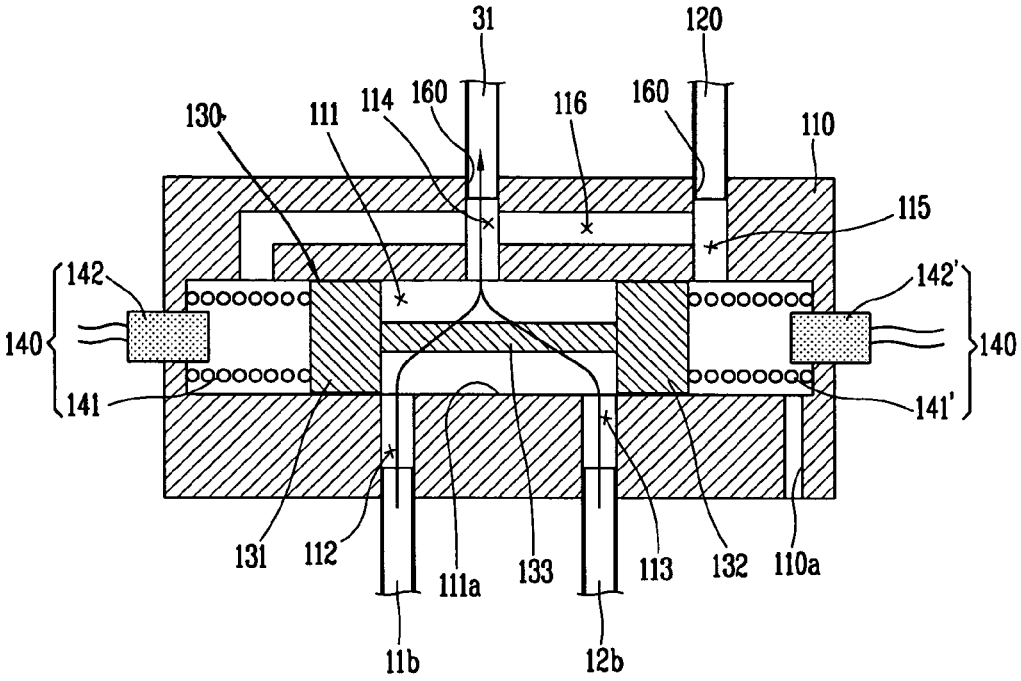
FIG. 5 is a longitudinal section view showing an operation state of the apparatus for converting a refrigerant pipe of an air conditioner according to the present invention in case that both a first compressor and a second compressor are operated.
Figure 6:
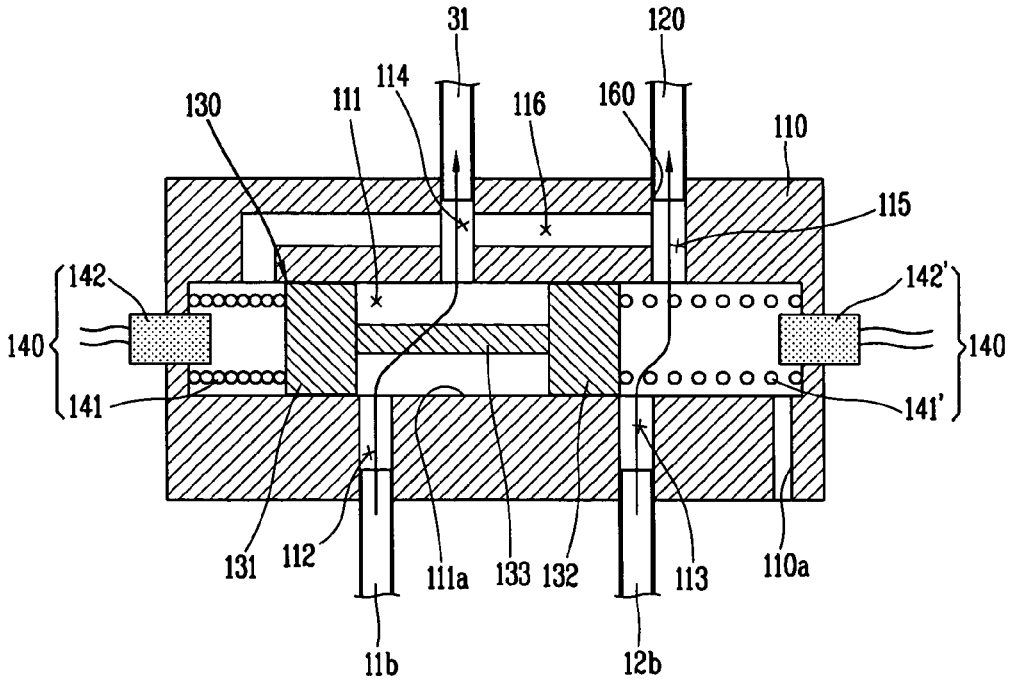
FIG. 6 is a longitudinal section view showing an operation state of the apparatus for converting a refrigerant pipe of an air conditioner according to the present invention in case that the first compressor is operated and the second compressor are stopped.
Figure 7:
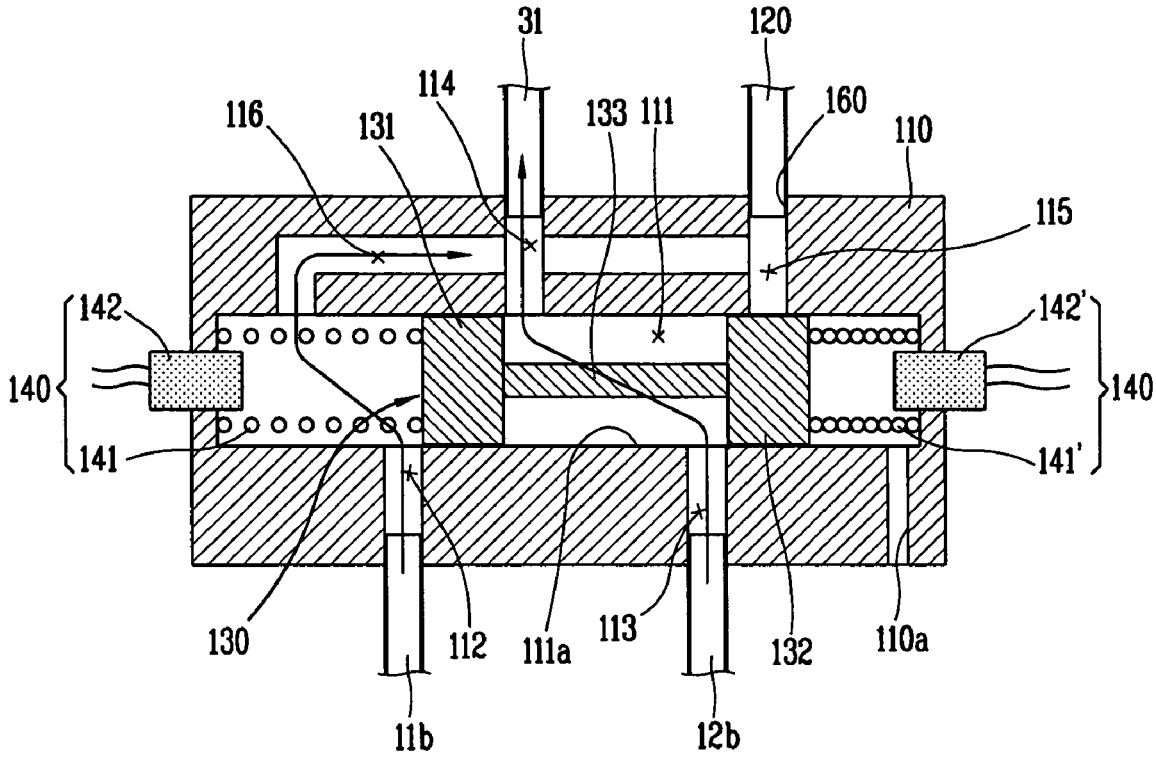
FIG. 7 is a longitudinal section view showing an operation state of the apparatus for converting a refrigerant pipe of an air conditioner according to the present invention in case that the first compressor is stopped and the second compressor is operated.

FIG. 4 is a perspective view showing an apparatus for converting a refrigerant pipe of an air conditioner according to the present invention, FIG. 5 is a longitudinal section view showing an operation state of the apparatus for converting a refrigerant pipe of an air conditioner according to the present invention in case that both a first compressor and a second compressor are operated, FIG. 6 is a longitudinal section view showing an operation state of the apparatus for converting a refrigerant pipe of an air conditioner according to the present invention in case that the first compressor is operated and the second compressor are stopped, and FIG. 7 is a longitudinal section view showing an operation state of the apparatus for converting a refrigerant pipe of an air conditioner according to the present invention in case that the first compressor is stopped and the second compressor is operated.

As shown, in an apparatus 100 for converting a refrigerant pipe of an air conditioner according to the present, a cylindrical valve housing 110 is installed in the middle of refrigerant discharge pipes 11*b* and 12*b*, that is, at a position where refrigerant discharge pipes 11*b* and 12*b* of a first compressor 11 and a second compressor 12 are put together.

A valve space portion 111 is long formed in the valve housing 110 in a horizontal direction.

The valve housing 110 is composed of: a first refrigerant inlet 112 formed at one lower portion thereof, for connecting the valve space portion 111 and the refrigerant discharge pipe 11*b* of the first compressor 11; a second refrigerant inlet 113 formed at another lower portion thereof, for connecting the valve space portion 111 and the refrigerant discharge pipe 12*b* of the second compressor 12; a refrigerant outlet 114 formed at one upper portion thereof and connected to a refrigerant circulation pipe 31 of the condenser 30; a bypass outlet 115 formed at another upper portion thereof and connected to the refrigerant circulation pipe 31 of the condenser 30; and a detour refrigerant outlet 116 formed at a side of the bypass outlet 115, for connecting the valve space portion 111 and the bypass outlet 115.

One end of the first refrigerant discharge pipe 11*b* of the first compressor 11 and one end of the second refrigerant discharge pipe 12*b* of the second compressor 12 are respectively fitted into the first refrigerant inlet 112 and the second refrigerant inlet 113 of the valve housing 110. Also, one end of the refrigerant circulation pipe 31 and one end of the bypass pipe 120 are respectively fitted into the refrigerant outlet 114 and the bypass outlet 115. A sealing member 160 is installed at an outer circumferential surface of the fitting portion, thereby preventing a refrigerant flowing through the valve space portion 111 of the valve housing 110 from being leaked to the outside.

An exhaust hole 110*a* for exhausting gas is formed at a lower portion of the valve housing 110.

The bypass pipe 120 is installed between the refrigerant outlet 114 of the valve housing 110 and the refrigerant suction pipes 11*a* and 12*a* of the first compressor 11 and the second compressor 12 so that a refrigerant discharged from each refrigerant discharge pipe 11*b* and 12*b* of the first compressor 11 and the second compressor 12 can be introduced into the refrigerant suction pipes 11*a* and 12*a* of the first compressor 11 and the second compressor 12.

An open/close valve 130 of a metal material is slidably installed at the valve space portion 111 of the valve housing 110 so that a refrigerant discharged from the refrigerant discharge pipes 11*b* and 12*b* can be selectively introduced into the refrigerant circulation pipe 31 of the condenser 30 or the bypass pipe 120.

Lubrication oil (not shown) is deposited to an inner wall 111*a* of the valve space portion 111 thereby to smoothly operate the open/close valve 130.

The open/close valve 130 is composed of: a first open/close portion 131 for opening and closing the refrigerant outlet 114; a second open/close portion 132 for opening and closing the bypass outlet 115; and a connection portion 133 for connecting the first open/close portion 131 and the second open/close portion 132.

The first open/close portion 131 and the second open/close portion 132 correspond to each other, and are adhered to the inner wall 111*a* of the valve space portion 111 with the same diameter. The connection portion 133 for connecting the first open/close portion 131 and the second open/close portion 132 is formed to have a diameter shorter than diameters of the first open/close portion 131 and the second open/close portion 132.

An open/close valve driving means 140 for driving the open/close vale 130 is installed at a side of the valve housing 110.

The open/close valve driving means 140 is composed of: a pair of springs 141 and 141' installed at both sides of the open/close valve 130; and a pair of electromagnets 142 and 142' installed at both sides of the valve housing 110, for overcoming an elastic force of the springs 141 and 141' and pulling the open/close valve 130.

When the electromagnets 142 and 142' are magnetized thus to pull the open/close valve 130, the first open/close portion 131 or the second open/close portion 132 of the open/close valve 130 selectively opens and closes the first refrigerant inlet 112, the second refrigerant inlet 113, the refrigerant outlet 114 and the bypass outlet 115 thereby to control a flow of a refrigerant. Then, the springs 141 and 141' restore the open/close vale 130 to the original position.

An operation of the apparatus for converting a refrigerant pipe of an air conditioner will be explained as follows.

As shown in FIGS. 4 and 5, when both the first compressor 11 and the second compressor 12 are operated, the electromagnet 142 is not magnetized and thereby the open/close valve 130 is positioned in the middle of the valve space portion 111 of the valve housing 110. At this time, whereas the first open/close portion 131 closes the detour refrigerant outlet 116 and the second open/close portion 132 closes the bypass outlet 115, the first refrigerant inlet 112 and the second refrigerant inlet 113 are connected to the refrigerant circulation pipe 31.

As the first refrigerant inlet 112 and the second refrigerant inlet 113 are connected to the refrigerant outlet 114, a refrigerant discharged from the refrigerant discharge pipes 11*b* and 12*b* of the first compressor 11 and the second compressor 12 passes through the valve space portion 111 thus to be introduced into the refrigerant circulation pipe 31 through the refrigerant outlet 114. Then, the refrigerant that has been introduced into the refrigerant circulation pipe 31 is circulated via the condenser 30 and the evaporator 40, and then is introduced into the refrigerant suction pipes 11*a* and 12*a* of the first compressor 11 and the second compressor 12 through a refrigerant circulation pipe 32.

As shown in FIGS. 4 and 6, when the first compressor 11 is operated and the second compressor 12 is stopped, the electromagnet 142 is magnetized and thereby the open/close valve 130 overcomes an elastic force of the spring 141 thus to move to the left side. At this time, the first open/close portion 131 closes the detour refrigerant outlet 116 and at the same time the second open/close portion 132 opens the bypass outlet 115, thereby connecting the first refrigerant inlet 112 to the refrigerant outlet 114 and connecting the second refrigerant inlet 113 to the bypass outlet 115.

As the open/close valve 130 moves by the electromagnet 142, the first refrigerant inlet 112 is connected to the refrigerant outlet 114 and the second refrigerant outlet 113 is connected to the bypass outlet 115. According to this, a refrigerant discharged from the refrigerant discharge pipe 11*b* of the first compressor 11 is introduced into the refrigerant circulation pipe 31 through the refrigerant outlet 114 via the valve space portion 111. Then, the refrigerant that has been introduced into the refrigerant circulation pipe 31 is circulated via the condenser 30 and the evaporator 40, and then is introduced into the refrigerant suction pipe 11*a* of the first compressor 11 through the refrigerant circulation pipe 32. Also, a refrigerant discharged from the refrigerant discharge pipe 12*b* of the second compressor 12 sequentially passes through the second refrigerant inlet 113, the valve space portion 111 and the bypass outlet 115 thereby to be introduced into the bypass pipe 120. Then, the refrigerant is introduced into the refrigerant suction pipes 11*a* and 12*a* of the first compressor 11 and the second compressor 12 through the refrigerant circulation pipe 32.

As shown in FIGS. 4 and 7, when the first compressor 11 is stopped and the second compressor 12 is operated, the electromagnet 142 is magnetized and thereby the open/close valve 130 overcomes an elastic force of the spring 141 thus to move to the right side. At this time, the first open/close portion 131 opens the detour refrigerant outlet 116 and at the same time the second open/close portion 132 closes the bypass outlet 115, thereby connecting the first refrigerant inlet 112 to the detour refrigerant outlet 116 and connecting the second refrigerant inlet 113 to the refrigerant outlet 114.

Figure 1:
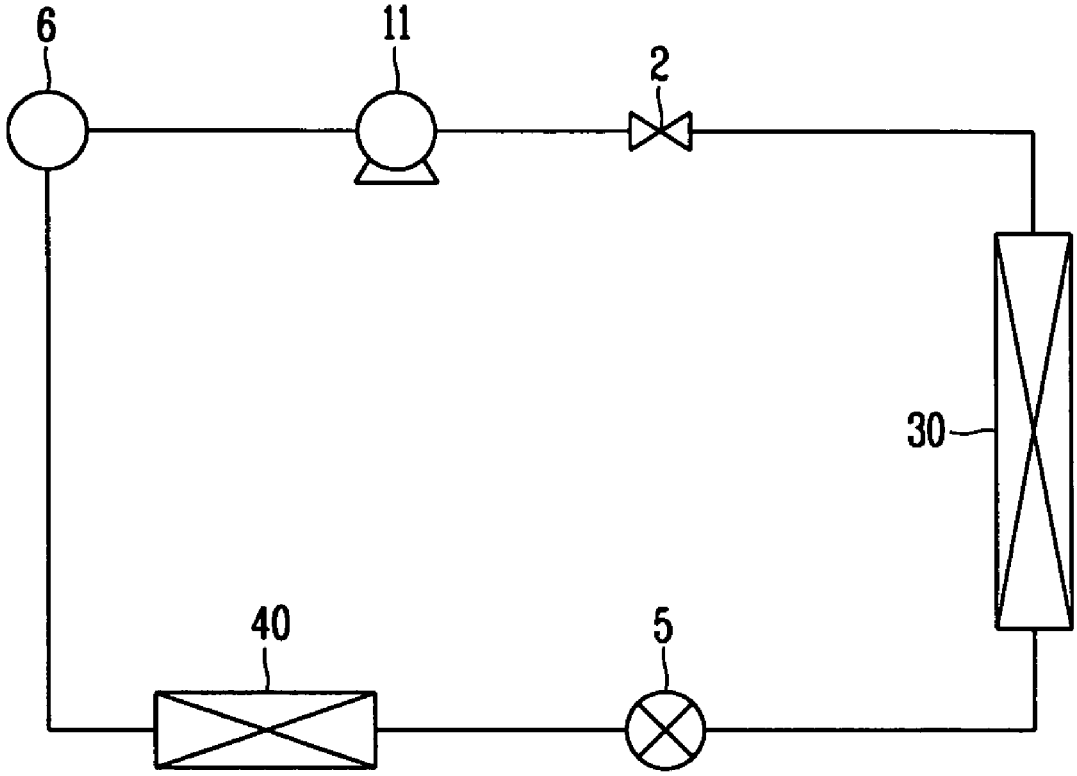
FIG. 1 CONVENTIONAL ART
FIG. 1 is a view showing a refrigerating cycle of an air conditioner in accordance with the conventional art.
Figure 2:
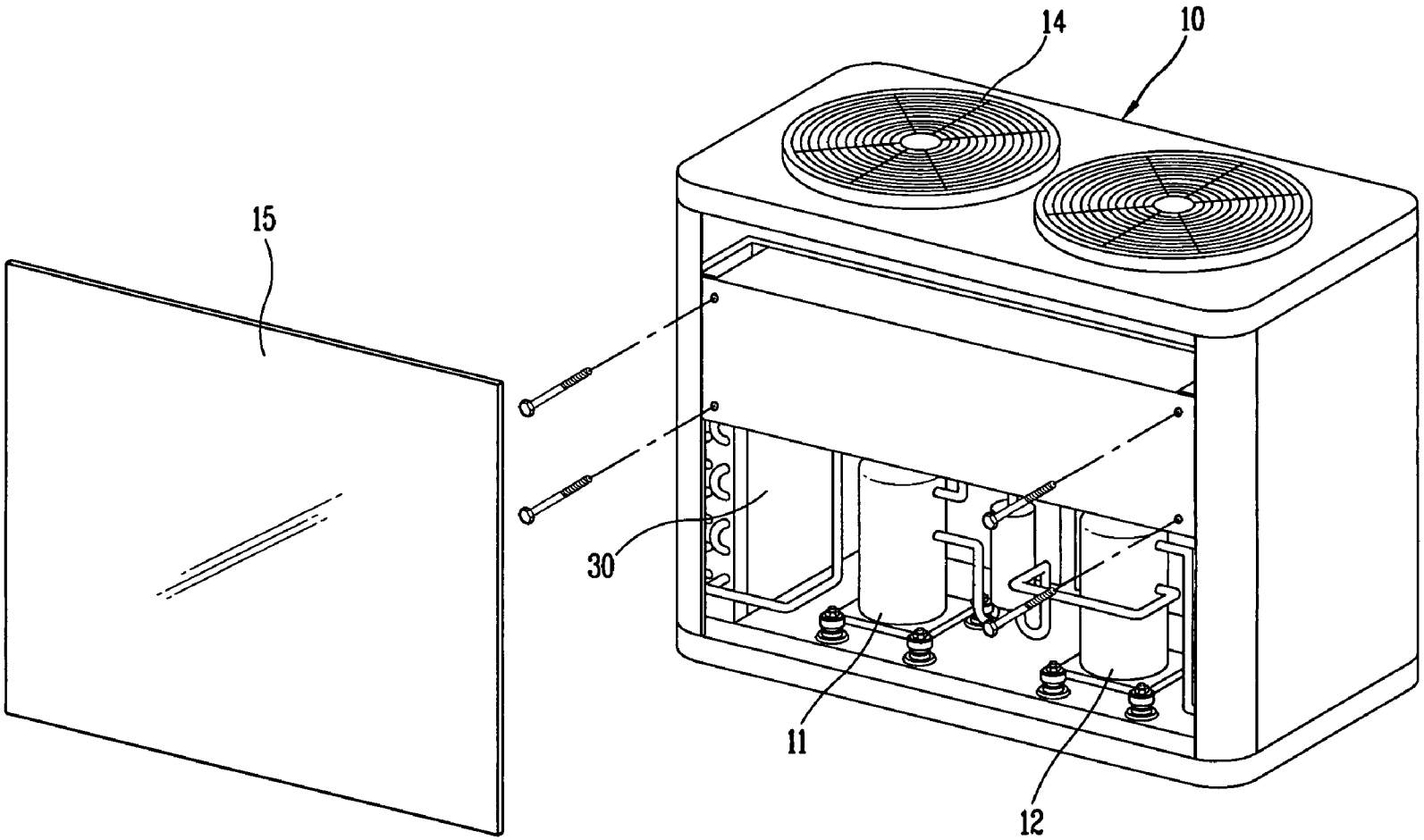
FIG. 2 CONVENTIONAL ART
FIG. 2 is a perspective view showing an outdoor unit of an air conditioner having plural compressors in accordance with the conventional art.
Figure 3:
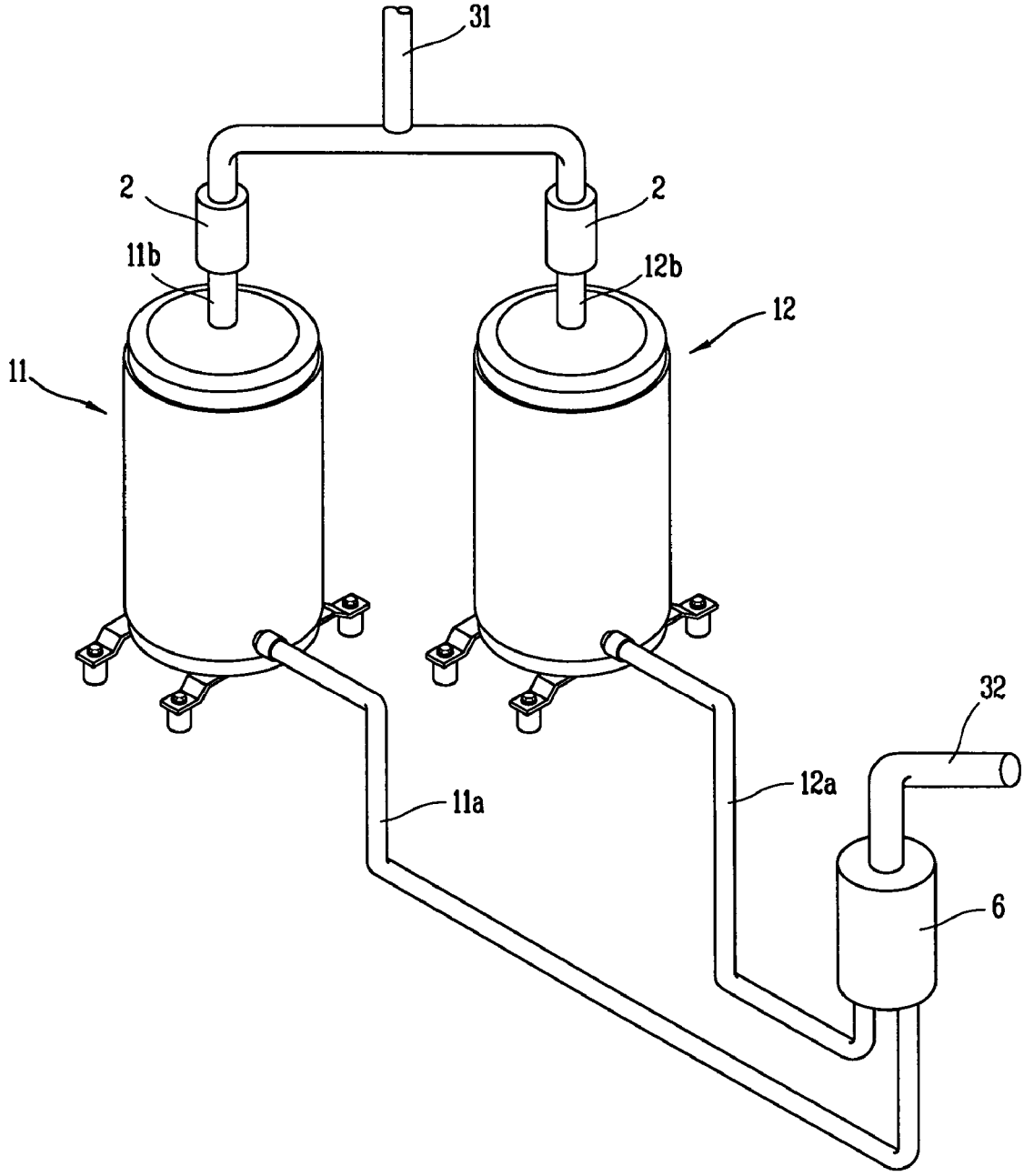
FIG. 3 CONVENTIONAL ART
FIG. 3 is a perspective view showing refrigerant pipes and check valves connected to the plural compressors of the air conditioner in accordance with the conventional art.

As the open/close valve 130 moves by the electromagnet 142, the first refrigerant inlet 112 is connected to the detour refrigerant outlet 116 and the second refrigerant outlet 113 is connected to the refrigerant outlet 114. According to this, a refrigerant discharged from the refrigerant discharge pipe 11*b* of the first compressor 11 sequentially passes through the first refrigerant inlet 112, the valve space portion 111 and the detour refrigerant outlet 116 thereby to be introduced into the bypass pipe 120. Then, the refrigerant that has been introduced into the bypass pipe 120 is re-introduced into the refrigerant suction pipe 11*a* of the first compressor 11 through the refrigerant circulation pipe 32. Also, a refrigerant discharged from the refrigerant discharge pipe 12*b* of the second compressor 12 is introduced into the refrigerant circulation pipe 31 through the refrigerant outlet 114 via the valve space portion 111. Then, the refrigerant that has been introduced into the refrigerant circulation pipe 31 is circulated via the condenser 30 and the evaporator 40 of FIG. 1, and then is introduced into the refrigerant suction pipe 12*a* of the second compressor 12 through the refrigerant circulation pipe 32.

Although not shown, when both the first compressor 11 and the second compressor 12 are stopped, a pressure difference is removed by moving the open/close valve 130 to the right side or the left side as shown in FIGS. 6 and 7.

When the air conditioner is stopped, the first open/close portion 131 closes the refrigerant outlet 114 and the detour refrigerant inlet 116, and at the same time, the second open/close portion 132 opens the bypass outlet 115. According to this, a backflow of a refrigerant flowing in the refrigerant circulation pipe 31 can be effectively prevented.

As aforementioned, in the apparatus for converting a refrigerant pipe of an air conditioner according to the present invention, a backflow of a refrigerant can be effectively prevented without using a check valve.

Also, a refrigerant discharged from the compressor is selectively introduced into the refrigerant circulation pipe of the condenser or the bypass pipe thus to remove a pressure difference between the refrigerant suction side and the refrigerant discharge side. According to this, the air conditioner can be fast re-operated even after the air conditioner is stopped to perform a defrosting operation for removing frost unnecessarily formed during a cooling operation or after the air conditioner is stopped since the air conditioner reaches a temperature desired by the user. According to this, the time to re-operate the air conditioner can be greatly reduced, and the air conditioner can be operated more conveniently and efficiently.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An apparatus for converting a refrigerant pipe of an air conditioner comprising:

a valve housing having a valve space portion therein, and composed of a first refrigerant inlet formed at one lower portion thereof and connecting the valve space portion and a refrigerant discharge pipe of a first compressor, a second refrigerant inlet formed at another lower portion thereof and connecting the valve space portion and a refrigerant discharge pipe of a second compressor, a refrigerant outlet formed at one upper portion thereof and connected to a refrigerant circulation pipe of a condenser, a bypass outlet formed at another upper portion thereof and connected to the refrigerant circulation pipe of the condenser, and a detour refrigerant outlet formed at a side of the bypass outlet and connecting the valve space portion to the bypass outlet;

a bypass pipe for connecting the bypass outlet of the valve housing to a refrigerant circulation pipe connected to refrigerant suction pipes of the first and second compressors;

an open/close valve slidably installed in the valve space portion of the valve housing so that a refrigerant introduced into the valve space portion of the valve housing through the refrigerant discharge pipes of the first and second compressors can be selectively introduced into the refrigerant circulation pipe of the condenser or the bypass pipe; and an open/close valve driving means installed at both sides of the open/close valve and driving the open/close valve.

2. The apparatus of claim 1, wherein the open/close valve is composed of:

a first open/close portion formed of a metal material and opening and closing the refrigerant outlet;

a second open/close portion for opening and closing the bypass outlet; and a connection portion for connecting the first open/close portion and the second open/close portion.

3. The apparatus of claim 2, wherein the first open/close portion and the second open/close portion correspond to each other and are adhered to an inner wall of the valve space portion with the same diameter, and the connection portion is formed to have a diameter shorter than diameters of the first open/close portion and the second open/close portion.

4. The apparatus of claim 1, wherein the open/close valve driving means is composed of:

a pair of springs installed at both sides of the open/close valve; and a pair of electromagnets installed at both sides of the valve housing, for overcoming an elastic force of the springs and pulling the open/close valve.

5. The apparatus of claim 1, wherein the valve housing is provided with an exhaust hole at a lower portion thereof.

6. The apparatus of claim 1, wherein the valve housing has a cylindrical shape.

7. The apparatus of claim 1, wherein one end of the first refrigerant discharge pipe of the first compressor and one end of the second refrigerant discharge pipe of the second compressor are respectively fitted into the first refrigerant inlet and the second refrigerant inlet of the valve housing with a sealed state, and one end of the refrigerant circulation pipe and one end of the bypass pipe are respectively fitted into the refrigerant outlet and the bypass outlet with a sealed state.

8. An apparatus for converting a refrigerant pipe of an air conditioner comprising:

a valve housing installed at a position where respective refrigerant discharge pipes of plural compressors are put together, and having a valve space portion therein;

a bypass pipe for connecting a refrigerant outlet of the valve housing to refrigerant suction pipes of the compressors so that a refrigerant discharged from each refrigerant discharge pipe of the plural compressors can be introduced to the refrigerant suction pipes of the plural compressors;

an open/close valve slidably installed at the valve space portion of the valve housing so that a refrigerant discharged from the refrigerant discharge pipes can be selectively introduced into a refrigerant circulation pipe of a condenser or the bypass pipe; and an open/close valve driving means installed at the valve housing and driving the open/close valve.

9. The apparatus of claim 8, wherein the valve housing is composed of:

a first refrigerant inlet formed at one lower portion thereof, for connecting the valve space portion of the valve housing and a refrigerant discharge pipe of a first compressor;

a second refrigerant inlet formed at another lower portion thereof, for connecting the valve space portion and a refrigerant discharge pipe of a second compressor;

a refrigerant outlet formed at one upper portion thereof and connected to the refrigerant circulation pipe of the condenser;

a bypass outlet formed at another upper portion thereof and connected to the refrigerant circulation pipe of the condenser; and a detour refrigerant inlet formed at a side of the bypass outlet, for connecting the valve space portion and the bypass outlet.

10. The apparatus of claim 8, wherein the open/close valve is formed of a metal material.

11. The apparatus of claim 8, wherein the open/close valve driving means is composed of:

a pair of springs installed at both sides of the open/close valve; and a pair of electromagnets installed at both sides of the valve housing, for overcoming an elastic force of the springs and pulling the open/close valve.

12. The apparatus of claim 8, wherein the open/close valve is composed of:

a first open/close portion for opening and closing the refrigerant outlet;

a second open/close portion for opening and closing the bypass outlet; and a connection portion for connecting the first open/close portion and the second open/close portion.

13. The apparatus of claim 12, wherein the first open/close portion and the second open/close portion correspond to each other and are adhered to an inner wall of the valve space portion with the same diameter, and the connection portion is formed to have a diameter shorter than diameters of the first open/close portion and the second open/close portion.

14. The apparatus of claim 8, wherein the valve housing has a cylindrical shape.

15. The apparatus of claim 8, wherein one end of the first refrigerant discharge pipe of the first compressor and one end of the second refrigerant discharge pipe of the second compressor are respectively fitted into the first refrigerant inlet and the second refrigerant inlet of the valve housing with a sealed state, and one end of the refrigerant circulation pipe and one end of the bypass pipe are respectively fitted into the refrigerant outlet and the bypass outlet with a sealed state.

16. The apparatus of claim 8, wherein the valve housing is provided with an exhaust hole at a lower portion thereof.

* * * * *